US011202999B1

(12) United States Patent
Harrison, Jr.

(10) Patent No.: US 11,202,999 B1
(45) Date of Patent: Dec. 21, 2021

(54) STIRRING SYSTEM AND METHOD OF USE

(71) Applicant: Robert Harrison, Jr., Texarkana, AR (US)

(72) Inventor: Robert Harrison, Jr., Texarkana, AR (US)

( * ) Notice: Subject to any disclaimer, the term of this patent is extended or adjusted under 35 U.S.C. 154(b) by 178 days.

(21) Appl. No.: 16/101,429

(22) Filed: Aug. 11, 2018

Related U.S. Application Data

(60) Provisional application No. 62/544,090, filed on Aug. 11, 2017.

(51) Int. Cl.
*B01F 7/00* (2006.01)
*B01F 15/00* (2006.01)

(52) U.S. Cl.
CPC ..... *B01F 7/0035* (2013.01); *B01F 7/003* (2013.01); *B01F 15/00006* (2013.01); *B01F 15/00662* (2013.01)

(58) Field of Classification Search
CPC .. B01F 7/003; B01F 7/0035; B01F 2215/005; A47J 43/044
USPC ..... 366/325.1
See application file for complete search history.

(56) References Cited

U.S. PATENT DOCUMENTS 1,905,114 A * 4/1933 Lauterbur ..... A47J 43/044 74/810.1
2,571,366 A * 10/1951 Jennings ..... B01F 7/32 366/282
3,162,338 A * 12/1964 Grubelic ..... B01F 13/1055 222/484
3,704,007 A * 11/1972 Kroeger ..... B44D 3/08 366/248
6,616,318 B1 * 9/2003 LeBlanc ..... B01F 7/001 366/129

* cited by examiner

*Primary Examiner* — Elizabeth Insler
(74) *Attorney, Agent, or Firm* — Leavitt Eldredge Law Firm

(57) ABSTRACT

A stirring system for a bucket having a sidewall configured to form an inner cavity for containing liquid therein. The system a lid having a center hole extending through the thickness of the lid; a shaft extending from a first end to a second end, the shaft is configured to extend through the center hold of the lid and into the inner cavity; a quick-release device secured to the first end of the shaft; an upper perforated stirring paddle rigidly attached to and extending from the shaft; a middle perforated stirring paddle rigidly attached to and extending form the shaft, the middle perforated stirring paddle is configured to extend in a first plane parallel to the upper perforated stirring paddle; and a lower perforated stirring paddle secured to the second end of the shaft and extending along a second plane, the lower perforated stirring paddle having a first length equal to a second length of the upper perforated stirring paddle plus a third length of the middle perforated stirring paddle.

3 Claims, 5 Drawing Sheets

STIRRING SYSTEM AND METHOD OF USE

BACKGROUND

1. Field of the Invention

The present invention relates generally to systems and methods to stir liquids within a container, and more specifically, to a stirring system and method of use having a lid adapted to fit on a bucket and configured to stir liquid within the bucket via one or more stirring paddles.

2. Description of Related Art

Devices configured to stir liquid, e.g., paint, within a bucket are well known in the art and are typically effective means for mixing. In FIG. 1, a conventional bucket 101 is shown, which could be utilized as a paint bucket having a body 103 forming an inner cavity for storing paint therein. During use, the painter will typically place a paint stick or other suitable means to stir the paint prior to use.

Although effective in most applications of use, it should be understood that paint sticks and/or other similar devices have significant disadvantages. For example, it typically requires a long duration of stirring for the paint to be ready for use when utilizing the common technique of stirring. Further, the pain disposed with the bucket has a tendency to spill over during the stirring process. Accordingly, there is a need for an apparatus and process that prevents spilling and can easily and rapidly stir the liquid therein the bucket.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
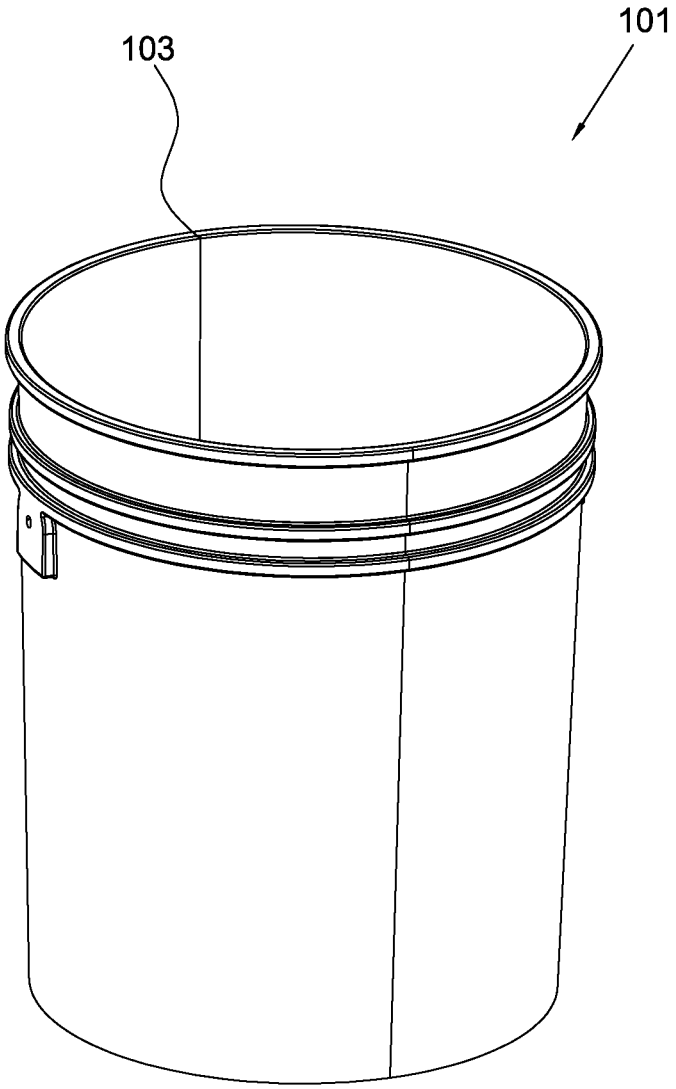
FIG. 1 (PRIOR ART)
FIG. 1 is an oblique view of a conventional bucket.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods to stir liquids carried within a container. Specifically, the system of the present application is configured to provide effective means to simultaneously close the bucket opening while also providing means to stir the liquid therein via a plurality of paddles. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Referring now to the drawings wherein like reference characters identify corresponding or similar elements throughout the several views, FIGS. 2-5 depict various views of a system and method of use in accordance with a preferred embodiment of the present application. It will be appreciated that system 201 overcomes one or more of the above-listed problems commonly associated with the conventional system and methods of use to stir liquid disposed within a container.

It should be understood that although the intended use of system 201 is for a paint bucket and for storing paint, it will be appreciated that the features discussed herein could be utilized for other types of containers and other types of liquids.

Figure 2:
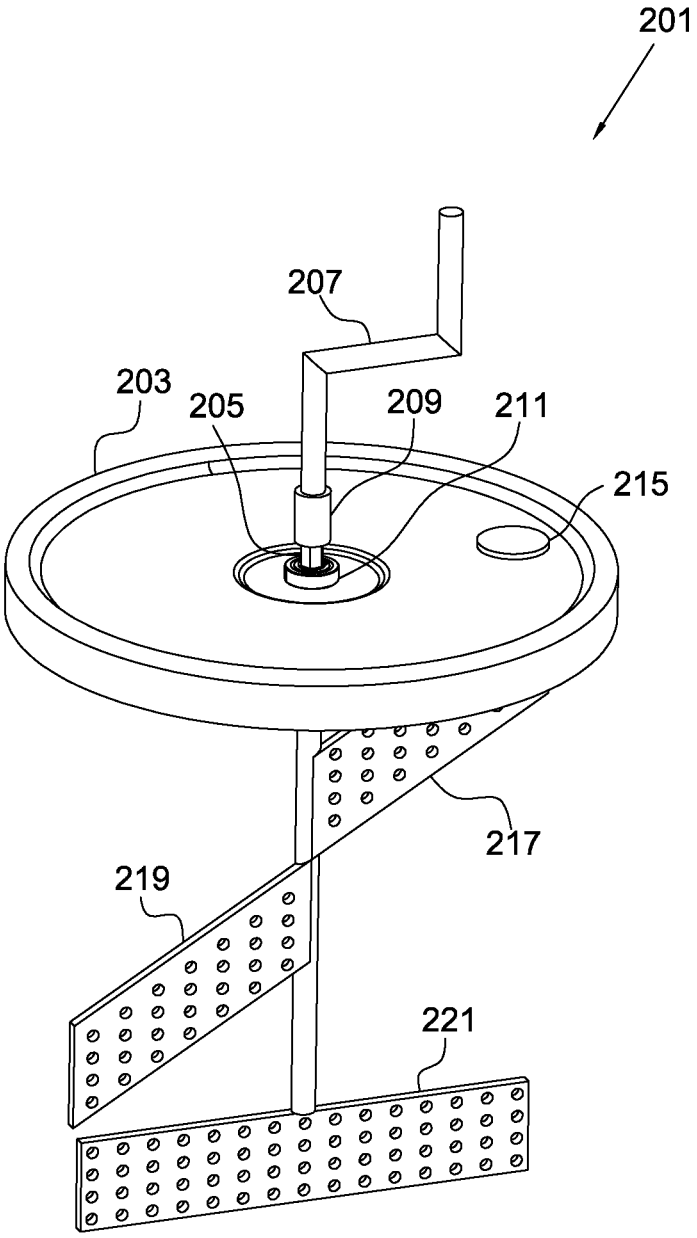
FIG. 2 is an oblique view of a system and method of use in accordance with a preferred embodiment of the present invention.
Figure 3:
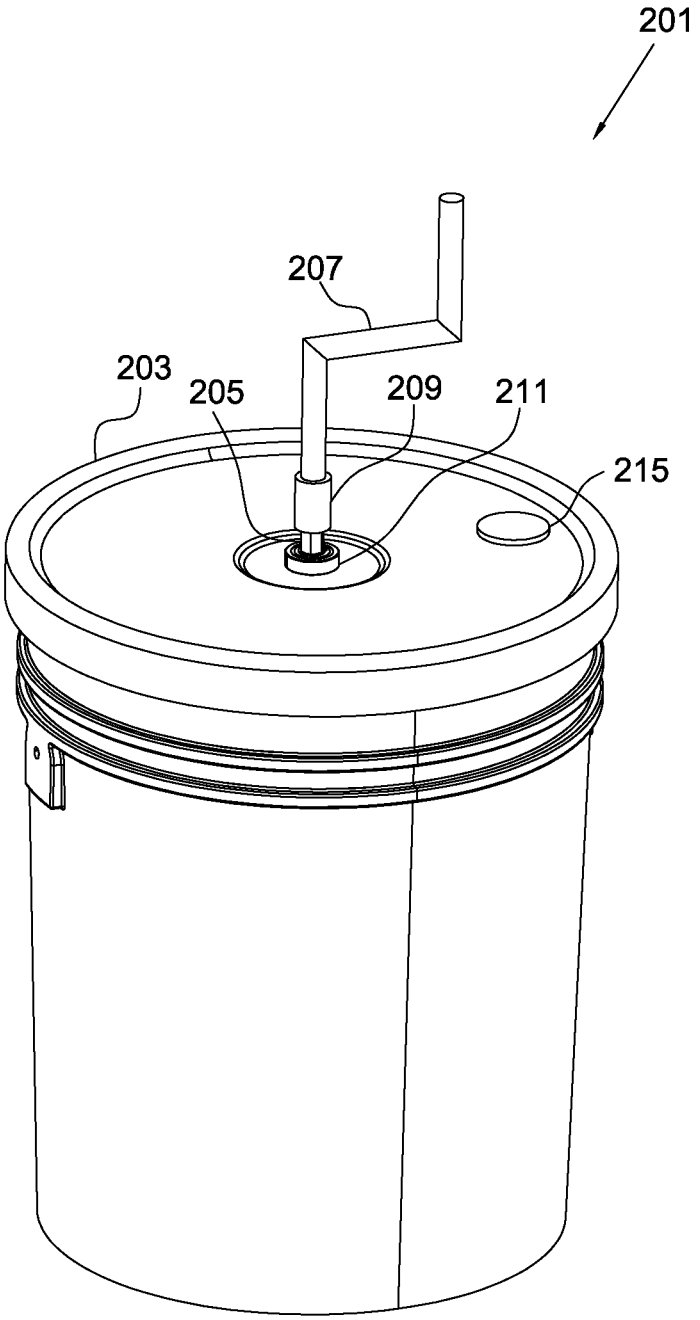
FIG. 3 is an oblique view of the system of FIG. 2 with the conventional bucket of FIG. 1.
Figure 4:
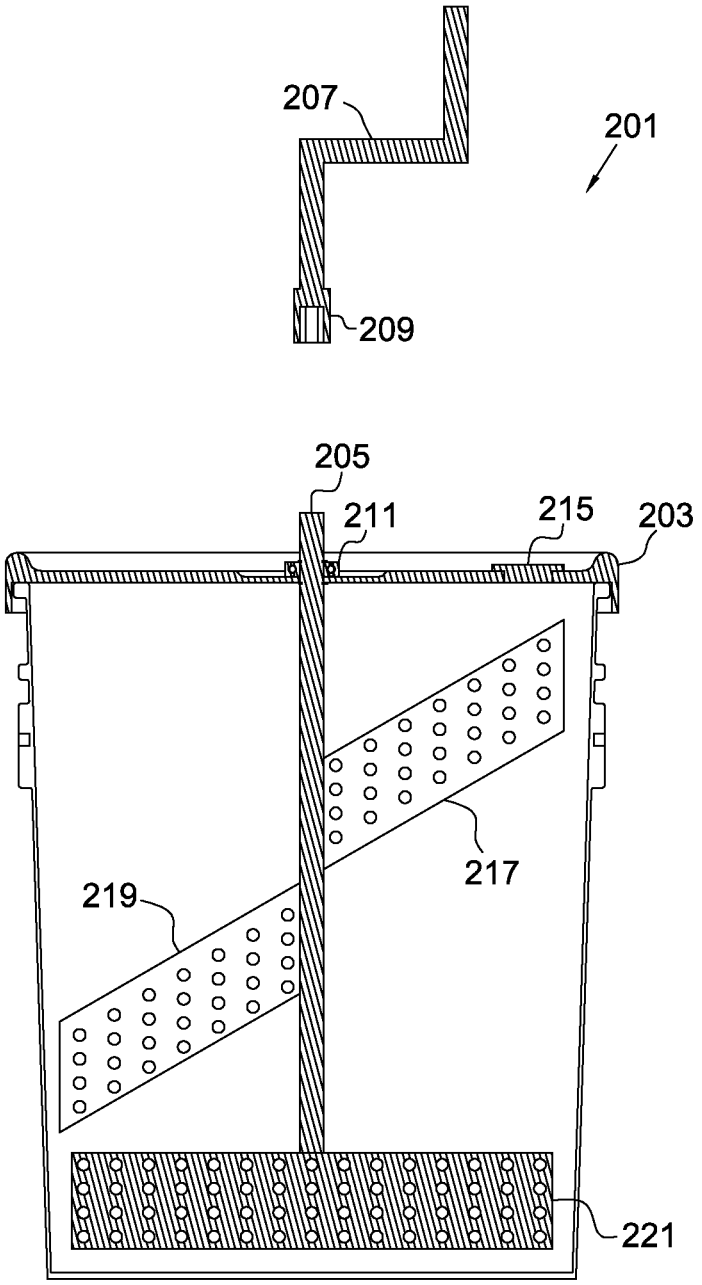
FIGS. 4 and 5 are front cross-sectional views of the system and bucket of FIG. 3.

Referring specifically to FIG. 2, system 201 includes one or more of a lid 203 configured to engage with the lip of container body 103 and securely fasten thereto. Positioned in the exact center of the lid 203 is a quick-release adapter fastener 211 configure to rotatably attach to the lid 203 and configured to fixedly engage with a shaft extending therefrom. A plurality of perforated paddles 217, 219, and 221 are selectively spaced apart from each other and oriented at predetermined angles relative to the shaft 205 for optimal stirring performance.

In the preferred embodiment, stirring paddle 217 is faced upward relative to downward facing stirring paddle 219 and relative to the elongated length of shaft 205, while paddle 221 is secured to the end of the shaft 205 and extends relatively perpendicular to the elongated length of the shaft 205. It is believed that the exemplary embodiment creates an optimal stirring effect when used.

In the illustrated embodiment, a manual stirring rod 207 is utilized to rotate the shaft 205 and associated stirring paddles 217, 219, and 221. The rod 207 includes an adapter 209 configure to removably attach to the quick-release device adapter fastener 211.

During use, the party will place the lid 203 on the rim of the bucket body 103 and secured thereto. This feature prevents the paint from spilling over the sides of the body 103 during the stirring process. Thereafter, the user secures stirring rod 207 to that quick-release adapter fastener 211 and stirs the paint via the plurality of paddles 217, 219, and 221. After the stirring process is complete, the party will open a port 215 that will allow the paint to be poured in another container (not shown).

Figure 5:
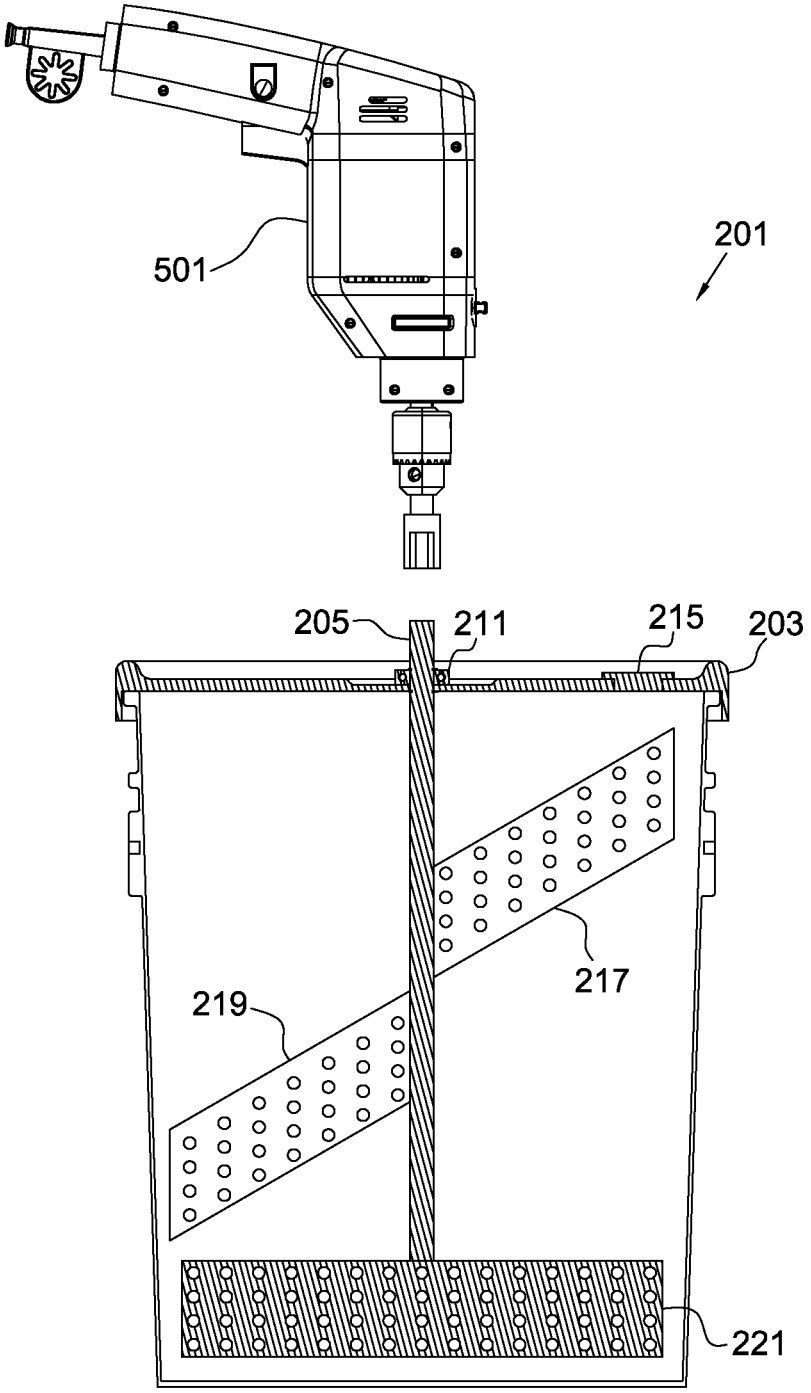

Referring specifically to FIG. 5, one of the unique features believed characteristic of the present invention is the use of the quick-release adapter fastener 211 configured to engage with a stir rod or a drill 501. In the exemplary embodiment, the drill 501 engages with fastener 211 and shaft 205 for rotation of the paddles. In one exemplary embodiment, the drill and/or rod could secure directly to the shaft or directly to the fastener 211, which in turn fixedly secures to the shaft 205. Both embodiments are contemplated herein.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A stirring system for a bucket having a sidewall configured to form an inner cavity for containing liquid therein, the system comprising:

a lid having a center hole extending through a thickness of the lid;

a shaft extending from a first end to a second end, the shaft is configured to extend through the center hole of the lid and into the inner cavity;

a quick-release device secured to the first end of the shaft;

an upper perforated stirring paddle having a top side, a bottom side and a plurality of holes and rigidly attached to and extending from the shaft, the upper perforated stirring paddle is oriented in a first angle relative to the shaft, the first angle is an acute angle between the top side of the upper perforated stirring paddle and the shaft;

a middle perforated stirring paddle having a top side, a bottom side and a plurality of holes and rigidly attached to and extending from the shaft, the top side of the middle perforated stirring paddle is configured to extend in a first plane parallel to the bottom side of the upper perforated stirring paddle, the middle perforated stirring paddle is oriented at a second angle relative to the shaft, the second angle is an obtuse angle between the top side of the middle perforated stirring paddle and the shaft; and a lower perforated stirring paddle having a plurality of holes and secured to the second end of the shaft and extending along a second plane, the lower perforated stirring paddle having a first length equal to a second length of the upper perforated stirring paddle plus a third length of the middle perforated stirring paddle, the lower perforated stirring paddle extending perpendicular to the shaft;

wherein the first plane is at an angle relative to the second plane; and wherein a rotation device secures to the quick-release device to rotate the shaft.

2. The system of claim 1, wherein the rotation device is a drill.

3. The system of claim 1, wherein the rotation device is a stirring rod configured to releasably engage with the quick-release device.

* * * * *